United States Patent [19]

Braun et al.

[11] 4,453,507

[45] Jun. 12, 1984

[54] CENTRIFUGALLY RESPONSIVE COMPRESSION RELEASE MECHANISM

[75] Inventors: Daniel E. Braun; Jack R. Bargenquast, both of Brookfield, Wis.

[73] Assignee: Briggs & Stratton Corporation, Wauwatosa, Wis.

[21] Appl. No.: 324,776

[22] Filed: Nov. 25, 1981

[51] Int. Cl.[3] ..... F01L 13/08

[52] U.S. Cl. ..... 123/182; 123/90.16

[58] Field of Search ..... 123/182, 90.16, 316; 417/294, 298

[56] References Cited

U.S. PATENT DOCUMENTS

| | | | |
|---|---|---|---|
| 3,314,408 | 4/1967 | Fenton | 123/182 |
| 3,362,390 | 1/1968 | Esty | 123/182 |
| 3,395,689 | 8/1968 | Kruse | 123/182 |
| 3,496,922 | 2/1970 | Campen | 123/182 |
| 3,620,203 | 11/1971 | Harkness | 123/182 |
| 3,901,199 | 8/1975 | Smith | 123/182 |

*Primary Examiner*—Andrew M. Dolinar

*Attorney, Agent, or Firm*—Andrus, Sceales, Starke & Sawall

[57] ABSTRACT

A centrifugally responsive compression release mechanism for an internal combustion engine. The release mechanism includes a yoke pivotally mounted to the camshaft and having an auxiliary cam member that is movable between an operative valve-unseating position and an inoperative position. A counterweight is associated with the legs of the yoke and causes the center of mass of the yoke to be offset from the plane containing the pivot axis. With this configuration, the yoke is biased by gravity at low rotational speeds to position the cam member in the operative valve-unseating position to thereby release compression in the combustion chamber of the engine. At engine running speeds, centrifugal force overcomes the gravitational force to pivot the yoke and the attached cam member to the inoperative position so that normal operation of the engine is not impaired.

10 Claims, 5 Drawing Figures

CENTRIFUGALLY RESPONSIVE COMPRESSION RELEASE MECHANISM

BACKGROUND OF THE INVENTION

This invention relates to an automatic compression relief mechanism for internal combustion engines and more particularly to centrifugally responsive apparatus by which, during the compression stroke of an internal combustion engine, compression is partially relieved at engine cranking speeds, but is allowed to build up to full value at running speeds.

Very generally the compression relief mechanism of the present invention is of the type disclosed in U.S. Pat. Nos. 3,314,408, 3,620,203, 3,901,199 and 3,981,289. In each of those prior devices, as in the mechanism of this invention, the valve that controls the flow of gas through a port communicating with the engine combustion chamber is held slightly off its seat during the compression stroke, at cranking speeds of the engine, to allow a certain amount of gas to be displaced through the port, thus relieving the force of compression that opposes cranking rotation of the engine crankshaft. At running speeds, the valve is permitted to remain seated during the compression stroke so that the normal performance of the engine is not impaired.

In the conventional compression release mechanism, the operation of the exhaust valve is controlled by an auxiliary cam member on the camshaft. The auxiliary cam member is arranged to move between an operative, radially extending position, in which the auxiliary cam member effects the desired unseating of the exhaust valve for compression relief, and a retracted inoperative position. The position of the auxiliary cam member is in turn controlled by a centrifugally actuated flyweight that is carried by the camshaft and is mounted for movement relative to the camshaft between defined limits in directions transverse to the camshaft axis. The flyweight is biased to one of its limits of motion and is moved to its other limit of motion by centrifugal force. A connection between the flyweight and the cam member translates the bias produced motion of the flyweight towards its one limit into movement of the cam member towards its extended or operative position, while movement of the flyweight under centrifugal force toward its other limit will retract the cam member to its inoperative position.

The prior compression relief expedients of the general type above described require multiple parts that have relatively complicated shapes or require special tooling and/or modification of the camshaft for installation.

A simplified compression release mechanism is shown in U.S. Pat. No. 3,314,408 in which a generally U-shaped centrifugally actuated latch is pivotally connected to the camshaft. One end of the latch defines an auxiliary cam member, while the opposite end of the latch is provided with a flyweight. The cam member is biased by a spring to the operative valve unseating position, and at running speeds the latch is pivoted to move the cam member to the inoperative position. The device of U.S. Pat. No. 3,314,408 is characterized by the fact that the valve load, when the cam member is in its operative position, is born solely by the pivot pin, thus requiring specially tempered or hardened metals for the pin to prevent failure.

SUMMARY OF THE INVENTION

The invention is directed to an improved centrifugally responsive compression release mechanism for an internal combustion engine. The mechanism includes a yoke having a pair of legs that straddle the cam shaft and are pivoted to the camshaft by a pivot pin. The saddle portion of the yoke, which connects the legs, includes an auxiliary cam member, while the legs are provided with counterweights that serve, under non-rotational conditions, to bias the yoke to a position in which the auxiliary cam member is in a valve unseating condition so that the auxiliary cam member will unseat the valve during the compression stroke at engine cranking speeds.

As the rotation speed of the camshaft increases, the centrifugal force acting through the center of mass overcomes the gravitational force and the yoke pivots in the opposite direction resulting in movement of the auxiliary cam member to an inoperative position so that the valve will remain seated during the compression stroke.

In accordance with yet another aspect of the invention, the auxiliary cam member is provided with a load bearing surface that engages the cam shaft, when the cam member is in the operative, valve unseating position, and thus distributes the valve load through the camshaft rather than through the pivot pin.

The present invention thus provides a dependable compression release mechanism that utilizes gravitational and centrifugal forces, and eliminates the need for multiple parts, as required with compression release mechanisms as used in the past.

The present invention also provides a simple, one-piece inexpensive compression release mechanism that can be readily installed without special tooling and without appreciable camshaft modification.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
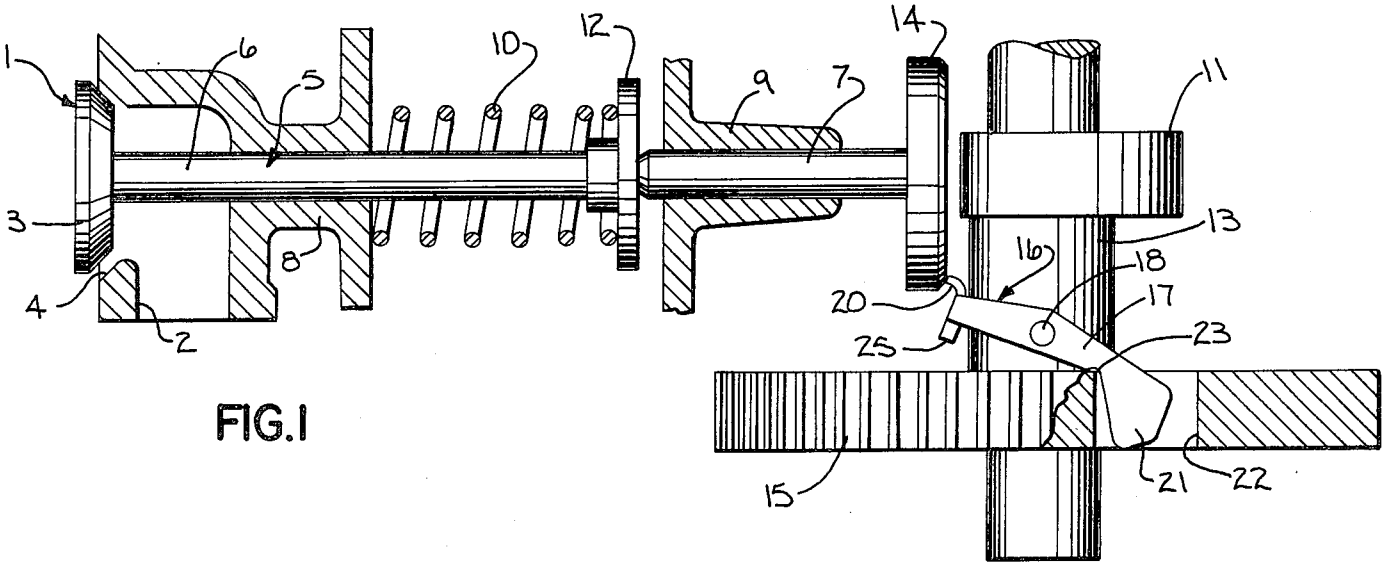
FIG. 1 is a side elevation of a valve of an internal combustion engine and actuating mechanism therefor that embodies the principles of this invention, the parts being shown in the positions they occupy during the compression stroke at engine cranking speeds.
Figure 2:
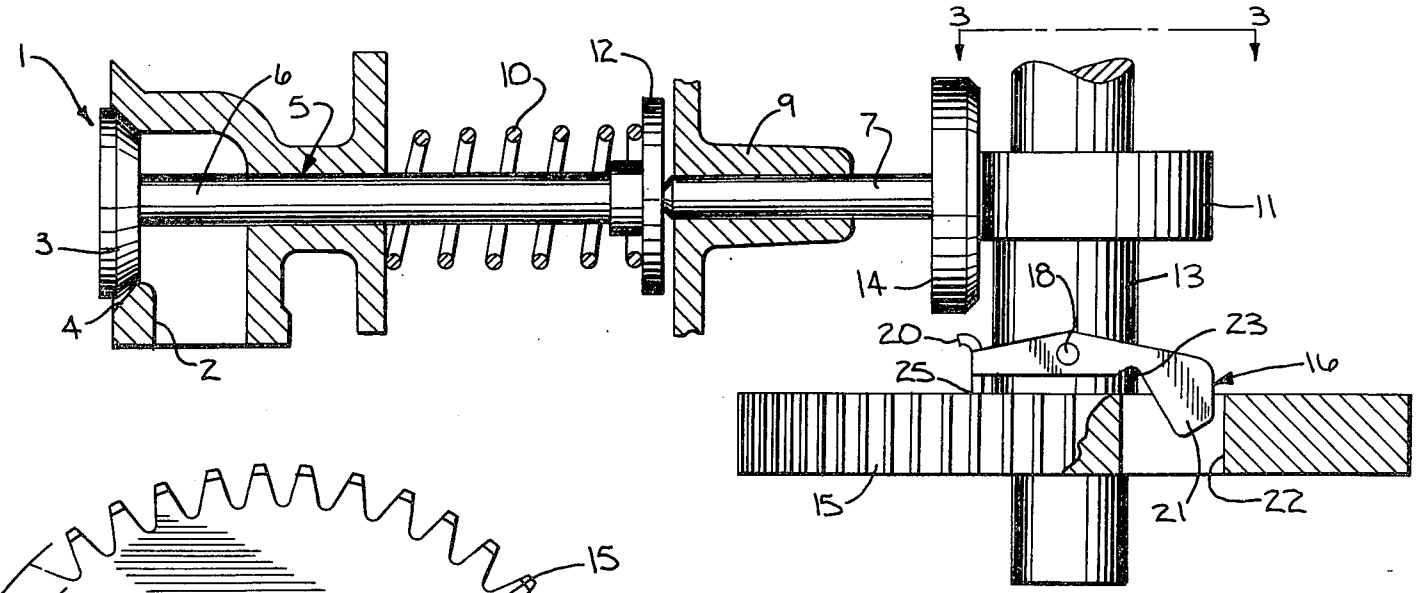
FIG. 2 is a view generally similar to FIG. 1, but showing the parts in the position they occupy at normal engine running speeds.
Figure 3:
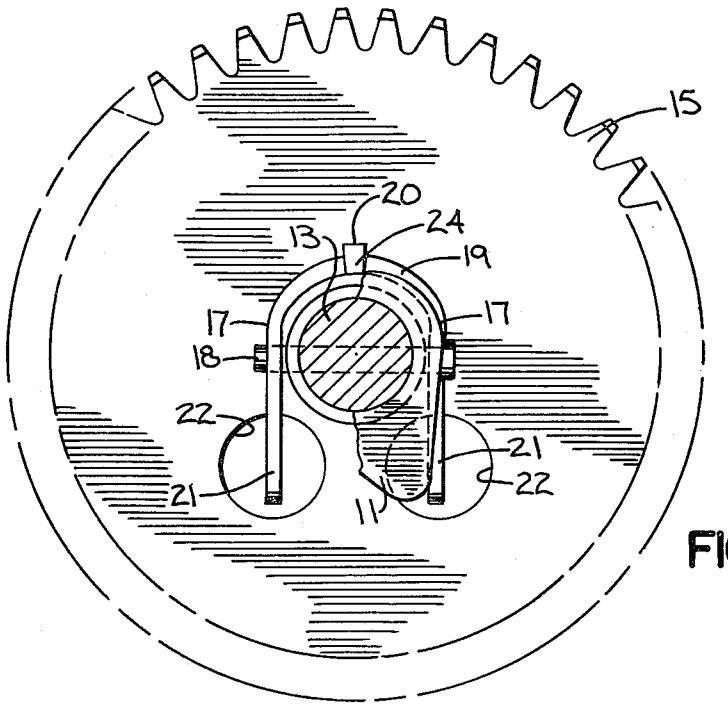
FIG. 3 is a sectional view taken along line 3—3 of FIG. 2.

As shown in FIGS. 1 and 2, a valve 1, which can be either an exhaust valve or an intake valve, controls flow of gas between a port 2 and the combustion chamber of the engine. The combustion chamber is not specifically illustrated but will be understood to be denoted by the area to the left of the valve in FIGS. 1 and 2.

The valve 1 is of the usual poppet type, having a head 3 that moves to and from engagement with a circumferential seat 4, the valve being closed when the head is engaged with its seat. The valve has an axially movable structure 5 that provides for its actuation between its closed position and an open position. Movable structure 5 comprises a stem 6 that is integral with the head 3 and extends therefrom, and a coaxial tappet 7 that is separated from the stem. The valve stem 6 is confined for axial motion in a valve guide 8 in the engine body, while the tappet 7 is similarly mounted in a coaxial tappet guide 9 in the engine body.

The valve 1 is actuated for its opening and closing motion by an actuating mechanism comprising a valve spring 10 and a cam 11. The valve spring 10 as is conventional, surrounds the valve stem and reacts between the surface of the valve guide and a spring retainer 12 at the end of valve stem 6, to bias the valve towards its closed position. The cam 11, which is on camshaft 13 that rotates in timed relation to the engine cycle, cooperates with follower 14 on tapper 7 to move the valve to its open position against the biasing force of the valve spring and to control the spring return of the valve towards engagement with its seat.

The camshaft is rotated by means of a cam gear 15, which, as is conventional, meshes with a timing gear (not shown) on the engine crankshaft.

According to the present invention, compression is released in the combustion chamber during the compression stroke at engine cranking speeds by a compression release member 16.

Figure 4:
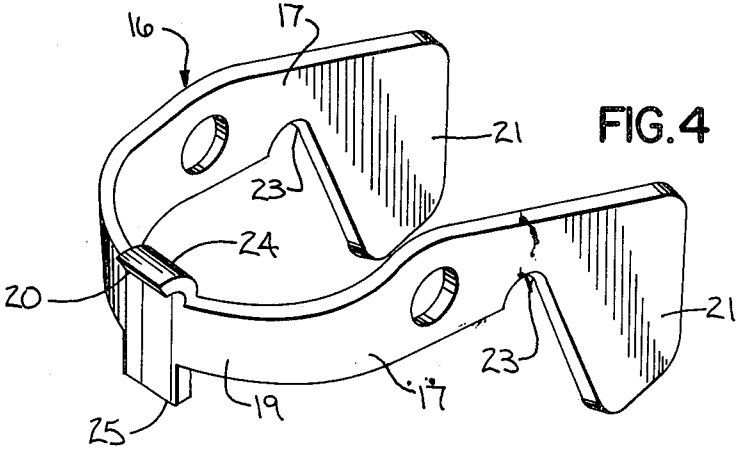
FIG. 4 is a perspective view of the compression relief yoke of the present invention.
Figure 5:
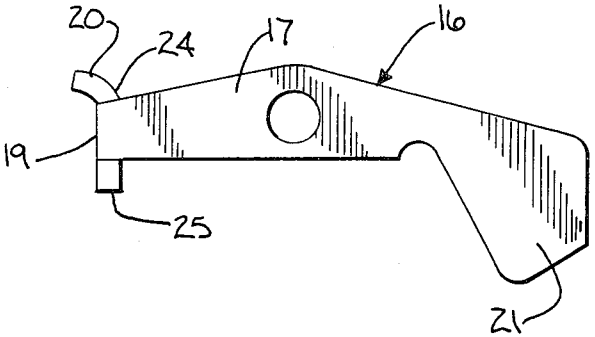
FIG. 5 is a side view of the compression relief yoke.

As shown in FIG. 4, the member 16 is yoke-shaped, having a pair of legs 17 that straddle camshaft 13 and are pivotally connected to the camshaft by means of pin 18. The legs 17 are connected together by a curved saddle or neck 19, and saddle 19 carries an outwardly curved projection 20 that constitutes an auxiliary cam member.

At the ends of legs 17 are counterweights 21 that extend along a line substantially parallel to the axis of rotation of camshaft 13. Counterweights 21 are received in holes 22 located in cam gear 15. The counterweights 21 serve to bias the yoke member 16 by gravity to the position shown in FIG. 1, in which the auxiliary cam member 20 is in the operative valve unseating position. Engagement of the notched edges 23 of legs 17 with the edges of gear 15 bordering holes 22 serves as a stop to limit the movement of the yoke member under gravitational force. In this condition, during cranking of the engine, the auxiliary cam member 20 will engage the follower 14 during the compression stroke to release compression in the combustion chamber.

Thus at low crankshaft speeds, auxiliary cam member 20 assumes its FIG. 1 position where it engages cam follower 14 to unseat valve 1 to release the compression. In this operable position the load and shock are transferred to camshaft 13 via load bearing surface 24 located at the base of the cam member 20.

As the crankshaft speed increases and reaches running speed, centrifugal force acting through the center of mass will pivot the yoke member 16 to the position shown in FIG. 2, causing the auxiliary cam member 20 to be displaced, generally in an axial direction, to the inoperative position where it will not interfere with the movement of follower 14. Engagement of projection 25 on yoke member 16 with gear 15 serves to limit the pivotal movement of the yoke member under centrifugal action.

When rotation of crankshaft 13 is slowed or stopped, the gravitational force will one again become dominant and yoke member 16 will pivot to its operable FIG. 1 position.

While the drawings show the compression release member 16 being biased to its operative position by gravity, it is contemplated that in certain installations, the compression release member may be biased to its operative position by a spring or other resilient element.

Various modes of carrying out the invention are contemplated as being within the scope of the following claims particularly pointing out and distinctly claiming the subject matter which is regarded as the invention.

I claim:

1. In an internal combustion engine having a valve which controls flow of gas through a port communicable with the engine combustion chamber and which is biased towards a seated position, valve operating means connected with said valve and against which a cam is cyclically engageable to unseat the valve, and a camshaft rotatable in timed relation to the engine cycle by a cam gear, automatic compression relief means for causing the valve to be unseated during a predetermined portion of each engine cycle at engine cranking speeds and to occupy its seated position during said engine cycle portion at engine running speeds, said automatic compression relief means comprising:

a generally U-shaped compression release member straddling the cam shaft and pivotally connected to the same by means of a pivot pin disposed transverse of said cam shaft, an auxiliary cam member disposed on the compression release member, biasing means to bias the compression release member in one direction about the pivot pin to positon said cam member in an operable position whereby the valve operating means will engage said cam member to unseat the valve on cranking of the engine, said compression release member having a load bearing surface spaced from said pivot pin and disposed in contact with the outer surface of said cam shaft when said cam member is in said operable position whereby the valve loads are transmitted from said cam member directly to the cam shaft, and means operable as a consequence of centrifugal force acting on said compression release member at engine running speed for pivoting the compression release member in the opposite direction to move said cam member to an inoperative positon where it will not be engaged by the valve operating means.

2. The construction of claim 1, wherein said auxiliary cam member is disposed on one end of the compression release member and said means operable as a consequence of centrifugal force comprises a flyweight that is disposed in the opposite end of the compression release member.

3. The construction of claim 2, wherein said auxiliary cam member at engine cranking speeds is located on one side of a plane passing through said pivot pin and disposed normal to the axis of said cam shaft and said flyweight is disposed on the opposite side of said plane.

4. In an internal combustion engine having a valve which controls flow of gas through a port communicable with the engine combustion chamber and which is biased toward a seated position, valve operating means connected with said valve and against which a cam is cyclically engageable to unseat the valve, and a camshaft rotatable in timed relation to the engine cycle by a cam gear, automatic compression relief means for causing the valve to be unseated during a predetermined portion of each engine cycle at engine cranking speeds and to occupy its seated position during said engine cycle portion at engine running speeds, said automatic compression relief means comprising:

a yoke including a pair of legs and a saddle connecting the legs together, said legs straddling the cam shaft and being pivotally connected to the cam shaft about a pivot axis, an auxiliary cam member extending outwardly from the saddle, biasing means to bias the yoke in a first direction about said pivot axis to position said cam member in an operative position whereby said cam member will engage the valve operating means at cranking speeds of the engine to unseat the valve, and a cam gear disposed on the camshaft and spaced axially of the cam, said gear having a pair of openings to receive the ends of said legs when said yoke is biased in said first direction, counterweight means associated with said legs, said counterweight means being positioned such that the center of mass of said yoke is offset from a plane passing through said pivot axis and disposed normal to the axis of the camshaft, an increase in speed of the camshaft causing the yoke to be pivoted by centrifugal force in the opposite direction to thereby move the auxiliary cam member to an inoperative position where it will not contact said valve operating means at engine running speeds.

5. The construction of claim 4, wherein the auxiliary cam member at low rotation speeds is located on one side of said plane and the center of mass of said yoke is located on the opposite side of said plane.

6. The construction of claim 4, and including a stop associated with the saddle and disposed to engage said gear to limited the pivotal movement of said yoke under centrifugal force.

7. In an internal combustion engine having a crankshaft, a compression chamber, intake and exhaust ports that open to the compression chamber and are controlled by valves that are biased to their closed positions and are cyclically opened with the engine is running by cams on a cam shaft acting through cam followers that are positioned to ride on said cams and are operatively connected with said valves, and wherein pressure in said compression chamber resists engine starting torque applied to the crankshaft, means for releasing pressure from the compression chamber during starting of the engine, comprising:

a compression release member having a cam follower engaging portion;

a pivot means mounting the compression release member on the cam shaft at a location adjacent to one of the cams thereon for rocking motion about an axis that is substantially transverse of the cam shaft and is spaced from the cam follower engaging portion of the compression release member a distance such that during rocking motion of the compression release member about the axis of the pivot means, said cam follower engaging portion is constrained to move to and from an operative position preventing closure of the valve controlled by the adjacent cam, said pressure releasing means being characterized by the fact that the dimensions and contour of the compression release member and the distribution of its mass with respect to the axis of the pivot means are such that in any disposition of the cam shaft in which the axes of the pivot means is nearer horizontal than vertical, and the speed of rotation of the cam shaft does not exceed that which is obtained during starting of the engine, the effect of gravity acting on the compression release member holds the same in a position in which said cam follower engaging portion is in its operative position while at higher speeds of cam shaft rotation the resulting increase in the effect of centrifugal force upon the compression release member rocks the latter to and holds it in a position in which said cam follower engaging portion is incapable of interfering with closure of the valve controlled by the adjacent cam; and by the fact that rocking movement of the compression release member about the axis of the pivot means is at all times free and unrestricted by any force other than the centrifugal force resulting from rotation of the cam shaft.

8. The invention defined by claim 7, further characterized in that the compression release member is a U-shaped metal stamping having spaced arms projecting from a central portion and straddling the cam shaft, with the pivot means joining said arms; and wherein said cam follower engaging portion of the compression release member is a tang bent up from said central portion.

9. The invention defined by claim 8, further characterized by:

a timing gear on the cam shaft adjacent to but spaced from the cam that controls the valve that is held against closing by the pressure releasing means, and by the fact that the U-shaped compression release member is located between the timing gear and said cam, said tang facing away from the timing gear, and the free portions of said spaced apart arms positioned to enter holes in the timing gear.

10. In an internal combustion engine having a valve which controls flow of glas through a port communicable with the engine combustion chamber and which is biased towards a seated position, valve operating means connected with said valve and against which a cam is cyclically engageable to unseat the valve, and a camshaft rotatable in timed relation to the engine cycle by a cam gear, automatic compression relief means for causing the valve to be unseated during a predetermined portion of each engine cycle at engine cranking speeds and to occupy its seated position during said engine cycle portion at engine running speeds, said automatic compression relief means comprising:

a yoke including a pair of legs and a saddle connecting the legs together, said legs straddling the cam shaft and being pivotally connected to the cam shaft about a pivot axis, an auxiliary cam member extending outwardly from the saddle, biasing means to bias the yoke in a first direction about said pivot axis to position said cam member in an operative position whereby said cam member will engage the valve operating means at cranking speeds of the engine to unseat the valve, said auxiliary cam member being generally curved and having a generally radially extending section terminating in an auxiliary cam surface, the base of said section constituting a load bearing surface disposed in contact with the cam shaft when the cam member is in the operative position so that the valve load is transmitted directly to the cam shaft, and a flyweight associated with at least one of said legs, said flyweight acting to pivot the yoke by centrifugal force on an increase in speed of the cam shaft in the opposite direction to thereby move the auxiliary cam member to an inoperative position where it will not contact said valve operating means at engine running speeds.

* * * * *